United States Patent [19]

Nagai et al.

[11] Patent Number: 4,779,414

[45] Date of Patent: Oct. 25, 1988

[54] DOUBLE AIR-FUEL RATIO SENSOR SYSTEM CARRYING OUT LEARNING CONTROL OPERATION

[75] Inventors: Toshinari Nagai, Susono; Takatoshi Masui, Mishima; Toshiyasu Katsuno, Susono, all of Japan

[73] Assignee: Toyota Jidosha Kabushiki Kaisha, Aichi, Japan

[21] Appl. No.: 928,010

[22] Filed: Nov. 7, 1986

[30] Foreign Application Priority Data

Jul. 26, 1986 [JP] Japan ..... 61-174722

[51] Int. Cl.[4] ..... F02D 41/14

[52] U.S. Cl. ..... 60/274; 60/276; 60/285; 123/489

[58] Field of Search ..... 123/440, 489, 589; 60/276, 285, 274; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,235,204 | 11/1980 | Rice | 123/440 |
| 4,251,989 | 2/1981 | Norimatsu et al. | 123/440 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |
| 4,703,619 | 11/1987 | Chujo et al. | 123/489 |
| 4,707,985 | 11/1987 | Nagai et al. | 123/489 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-48755 | 3/1983 | Japan . |
| 58-48756 | 3/1983 | Japan . |
| 58-53661 | 3/1983 | Japan . |
| 58-72647 | 4/1983 | Japan . |
| 58-72646 | 4/1983 | Japan . |
| 58-135343 | 8/1983 | Japan . |
| 58-150039 | 9/1983 | Japan . |
| 58-152147 | 9/1983 | Japan . |
| 58-150038 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar

*Attorney, Agent, or Firm*—Parkhurst, Oliff & Berridge

[57] ABSTRACT

In a double air-fuel sensor system including two air-fuel ratio sensors upstream and downstream of a catalyst converter provided in an exhaust gas passage, an actual air-fuel ratio is adjusted in accordance with the outputs of the upstream-side and downstream-side air-fuel ratio sensors including an air-fuel ratio correction amount. Also, a learning correction amount is calculated so that an integration amount of the air-fuel ratio correction amount is brought close to a reference value. The actual air-fuel ratio is further adjusted in accordance with the learning correction amount.

2 Claims, 22 Drawing Sheets

| Fig. 5A | Fig. 5B | Fig. 5C |
|---|---|---|

LEAN
RICH
A/F1

TDR1
CDLY1
0
t1
t2
t3
t4
t5
t6
t7
t8
TDL1
A/F1'
(F1)

TDR1
(-TDL1)
LEAN
RICH
TD R1

KIR
FAF1
RSL
RSR
KIL

| Fig. 7A | Fig. 7 B | Fig. 7 C |
|---|---|---|

Fig. 9
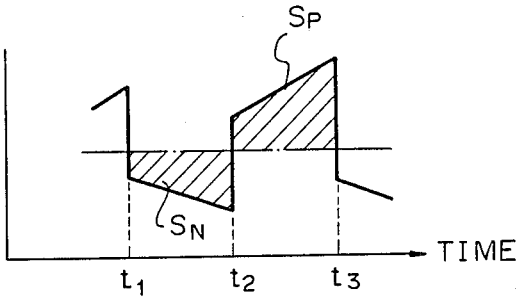
Fig.17A
Fig.17B
Fig.17C
Fig.17D
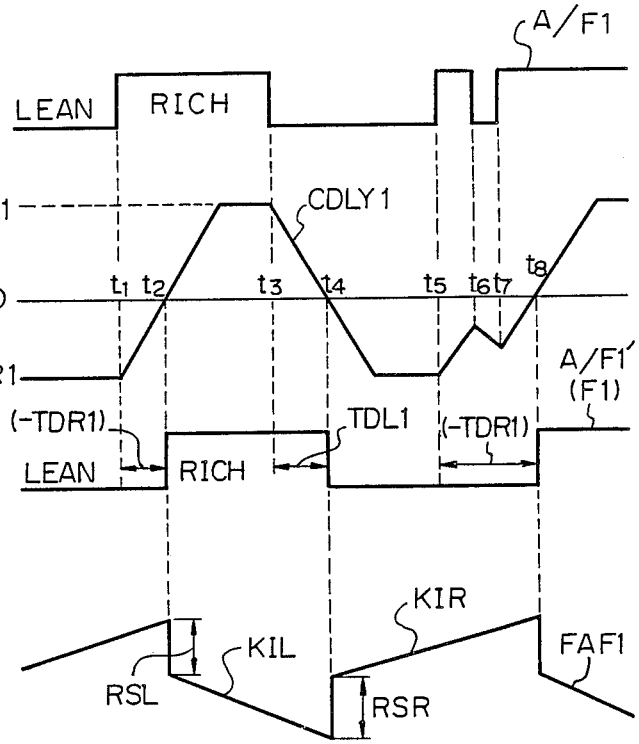

V
1
0
V1
VR1
RICH
LEAN
TDR1
(-TDL1)
F1
KIR
RSL
FAF1
RSR
KIL
V2
VR2
(-TDL2)
TDR2
F2
KI2
RS2
FAF2

| Fig.13 A | Fig.13 B |
|---|---|

V
1
0
V1
VR1

RICH
LEAN

TDR1
(-TDL1)
F1

KIR
RSL
FAF1
RSR
KIL

V
1
0
V2
VR2

LEAN
RICH (-TDL2)
TDR2
F2

MAX
RSR
MIN

MAX
RSL
MIN

DOUBLE AIR-FUEL RATIO SENSOR SYSTEM CARRYING OUT LEARNING CONTROL OPERATION

BACKGROUND OF THE INVENTION (1) Field of the Invention

The present invention relates to a method and apparatus for feedback control of an air-fuel ratio in an internal combustion engine having two air-fuel ratio sensors upstream and downstream of a catalyst converter disposed within an exhaust gas passage.

(2) Description of the Related Art

Generally, in a feedback control of the air-fuel ratio senso ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio.

According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_X$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor is addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstreamside $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, however, the air-fuel ratio correction coefficient FAF may be greatly deviated from a reference value such as 1.0 due to individual differences in the characteristics of the parts of the engine, individual changes caused by aging, environmental changes, and the like. For example, when driving at a high altitude (above sea level), the air-fuel ratio correction coefficient FAF is remarkably reduced, thereby obtaining an optimum air-fuel ratio such as the stoichiometric air-fuel ratio. In this case, a maximum value and a minimum value are imposed on the air-fuel ratio correction coefficient FAF, thereby preventing the controlled air-fuel ratio from becoming overrich or overlean. Therefore, when the air-fuel ratio correction coefficient FAF is close to the maximum value or the minimum value, the margin of the air-fuel ratio correction coefficient FAF becomes small, thus limiting the compensation of a transient change of the controlled air-fuel ratio. Also, when the engine is switched from an air-fuel ratio feedback control (closed-loop control) by the upstream-side and downstream-side $O_2$ sensors to an open-loop control, the air-fuel ratio correction coefficient FAF is made the reference value ($=1.0$), thereby causing an overrich or overlean condition in the controlled air-fuel ratio, and thus deteriorating the fuel consumption, the drivability, and the condition of the exhaust emissions such as HC, CO, and $NO_X$, since the sir-fuel ratio correction coefficient FAF ($=0.1$) during an open-loop control is, in this case, not an optimum level. Further, it takes a long time for the controlled air-fuel ratio to reach an optimum level after the engine is switched from an open control to an air-fuel ratio feedback control by the upstream-side and downstream-side $O_2$ sensors, thus also deteriorating the fuel consumption, the drivability, and the condition of the exhaust emissions.

Accordingly, a learning control operation has been introduced into a double $O_2$ sensor system, so that a mean value of the air-fuel ratio correction coefficient FAF, i.e., a mean value of successive values of the air-fuel ratio correction coefficient FAF immediately before skip operations is always changed around the reference value such as 1.0. Therefore, the margin of the air-fuel ratio correction coefficient FAF is always large, and accordingly, a transient change in the controlled air-fuel ratio can be compensated. Also, a difference in the air-fuel ratio correction coefficient FAF between an air-fuel ratio feedback control and an open-loop control becomes small. As a result, the deviation of the controlled air-fuel ratio in an open-loop control from its optimum level is small, and in addition, the controlled air-fuel ratio promptly reaches an optimum level after the engine is switched from an open-loop control to an air-fuel ratio feedback control.

In the double $O_2$ sensor system, however, when the air-fuel ratio feedback control by the two $O_2$ sensors is carried out, particularly, when air-fuel ratio feedback control parameters such as a skip amount RSR and a lean skip amount RSL are changed by the air-fuel ratio feedback control by the downstream-side $O_2$ sensor, the air-fuel ratio feedback control parameters are usually asymmetrical, i.e., RSR=RSL. Therefore, when the learning correction amount FGHAC is calculated so that the mean value FAFAV' of the air-fuel ratio correction coefficient FAF is brought close to the reference value such as 1.0, an erroneous learning control operation may be carried out, since the above-mentioned mean value FAFAV' does not indicate an exact mean value of the air-fuel ratio correction coefficient FAF, i.e., a real deviation of the air-fuel ratio. As a result, a deviation occurs in the original value of the learning correction amount FGHAC. Therefore, when the engine is switched by the upstream-side and downstream-side $O_2$ sensors from an air-fuel ratio feedback control to an open-loop control, the base air-fuel ratio is shifted from an optimum level by the deviation of the learning correction amount FGHAC, thus deteriorating the fuel consumption, the drivability, and the condition of the exhaust emissions.

On the other hand, when the air-fuel ratio feedback control by the downstream-side $O_2$ sensor is stopped during an off-idling mode or the like, the air-fuel ratio feedback control parameters are symmetrical (RSR=RSL). In this case, however, when the air-fuel ratio feedback control by the upstream-side $O_2$ sensor is carried out, and in addition, the learning correction amount FGHAC is calculated so that the mean value FAFAV' of the air-fuel ratio correction coefficient FAF is brought close to the reference value such as 1.0, the mean value FAFAV' indicates an exact mean value of the air-fuel ratio correction coefficient FAF. Therefore, in a transient mode from an air-fuel ratio feedback control by the upstream-side and downstream-side $O_2$ sensors to an air-fuel ratio feedback control by only the upstream-side $O_2$ sensor, or vice versa, or in a transient mode from an off-idling state to an on-idling state, or vice versa, the deviation of the learning correction amount FGHAC is corrected by the air-fuel ratio feedback control by the upstream-side $O_2$ sensor, so that the base air-fuel ratio is deviated from an optimum value in such a transient mode, thereby also deteriorating the fuel consumption, the drivability, and the condition of the exhaust emissions.

SUMMARY OF THE INVENTION

It is an object of the present invention to provide a double air-fuel ratio sensor system in an internal combustion engine with which the fuel consumption, the drivability, and the exhaust emission characteristics are improved during an open-loop control and during a transient mode.

According to the present invention, in a double air-fuel ratio sensor system including two $O_2$ sensors upstream and downstream of a catalyst converter provided in an exhaust passage, an actual air-fuel ratio is adjusted by using the output of the upstream-side $O_2$ sensor and the output of the downstream-side $O_2$ sensor. In this system, an air-fuel ratio correction coefficient FAF is calculated in accordance with the output of the upstream-side $O_2$ sensor, and a learning correction amount FGHAC is calculated so that an integration amount of the air-fuel ratio correction coefficient FAF is brought close to the reference value.

BRIEF DESCRIPTION OF THE DRAWINGS

The present invention will be more clearly understood from the description as set forth below with reference to the accompanying drawings, wherein:

FIG. 9 is a timing diagram explaining the flow chart of FIG. 8;

FIGS. 17A through 17D are timing diagrams explaining the flow chart of FIG. 16.

DESCRIPTION OF THE PREFERRED EMBODIMENTS

The principle of the present invention will be first explained with reference to FIGS. 2 and 3.

Figure 1:
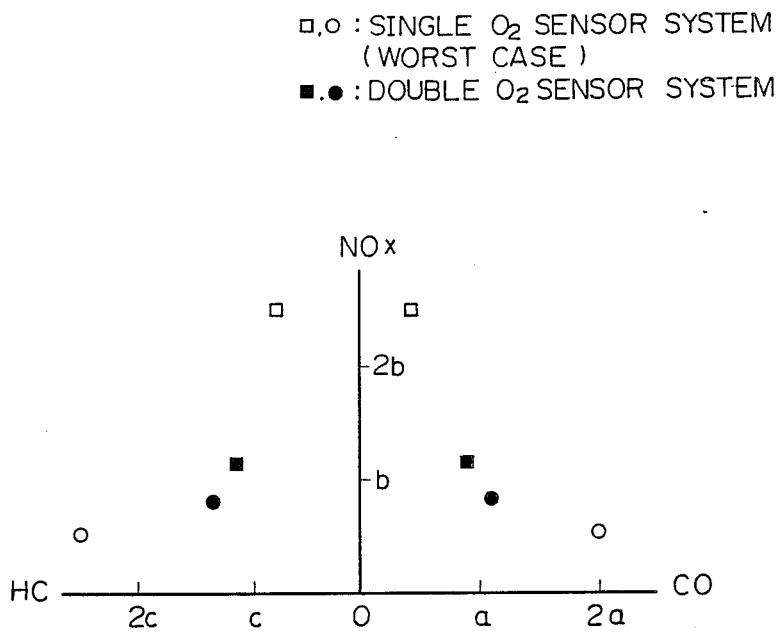
FIG. 1 is a graph showing the emission characteristics of a single $O_2$ sensor system and a double $O_2$ sensor system.
Figure 2:
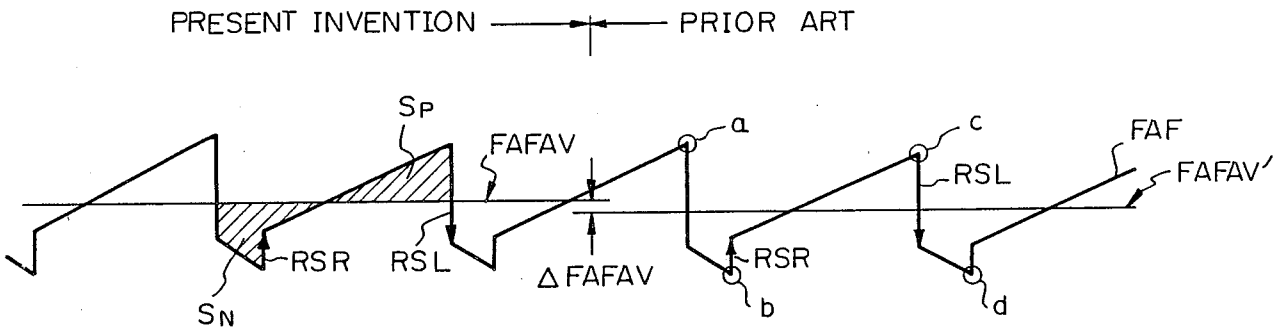
FIGS. 2 and 3 are timing diagrams explining the principle of the present invention.
Figure 3:
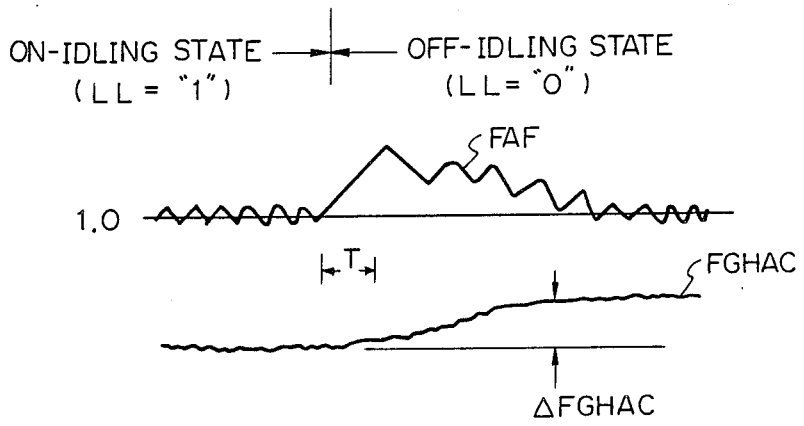
Fig. 3 PRIOR ART

As illustrated in FIG. 2, an integration amount indicated by FAFAV according to the present invention is determined so that an area $S_p$, called a positive integration amount, is the same as an area $S_N$, called a negative integration amount. Then, a learning correction amount FGHAC is calculated so that the integration amount FAFAV is brought close to the reference value such as 1.0. In this case, if the air-fuel ratio feedback by the upstream-side $O_2$ sensor 13 is carried out, a fuel injection amount is proportional to:

$$FAF+FGHAC \quad (1)$$

On the other hand, in an open-loop control, the fuel injection amount is proportional to:

$$1.0+FGHAC \quad (2)$$

Therefore, the learning correction amount FGHAC during an air-fuel ratio feedback control by the upstream-side $O_2$ sensor is substantially the same as that during an open-loop control. Namely, the learning correction amount FGHAC is substantially the same regardless of an air-fuel ratio feedback by the downstream-side $O_2$ sensor. As a result, the base air-fuel ratio is not deviated from the optimum level during an open-loop control. Also, when the engine is switched from an air-fuel ratio feedback by the two $O_2$ sensors to an air-fuel ratio feedback control by only the upstream-side $O_2$ sensor, or vice versa, the learning correction amount FGHAC is substantially the same, and accordingly, the base air-fuel ratio during a transient mode is not deviated from the optimum level.

Contrary to the above, as in the prior art, when a mean value, indicated by FAFAV' in FIG. 2, is calculated by a mean value (a+b)/2, (b+c)/2, . . . of the air-fuel ratio feedback correction coefficient FAF before skip operations, if RSR=RSL (asymmetrical), a difference ΔFAFAV between the mean value FAFAV' and the integration amount FAFAV according to the present invention occurs:

$$\Delta FAFAV = FAFAV - FAFAV'.$$

As a result, in this case, the learning correction amount FGHAC is increased by ΔFGHAC as compared with the present invention. That is, if an air-fuel ratio feedback by the two $O_2$ sensors is carried out, the fuel injection amount is proportional to:

$$FAF + FGHAC + \Delta FGHAC \quad (3)$$

On the other hand, the fuel injection amount during an open-loop control is proportional to:

$$1.0 + FGHAC + \Delta FGHAC \quad (4)$$

Therefore, from the formulas (2) and (4), during an open-loop control, the fuel injection amount is increased by ΔFGHAC, thereby enriching the controlled air-fuel ratio, as compared with the present invention.

Further, when an air-fuel ratio feedback control is made by only the upstream-side $O_2$ sensor (RSR=RSL), the fuel injection amount is proportional to:

$$FAF + FGHAC \quad (5)$$

Therefore, a difference in the learning correction amount FGHAC between an air-fuel ratio feedback control by the two $O_2$ sensors and an air-fuel ratio feedback control by only the upstream-side $O_2$ sensor occurs. Therefore, in a transient mode therebetween as indicated by a period T in FIG. 3, the base air-fuel ratio is shifted from the optimum level. Note that, in FIG. 3, in an on-idling state, an air-fuel ratio feedback control by only the upstream-side $O_2$ sensor is carried out, and in an off-idling state, an air-fuel ratio feedback control by the two $O_2$ sensors is carried out.

Figure 4:
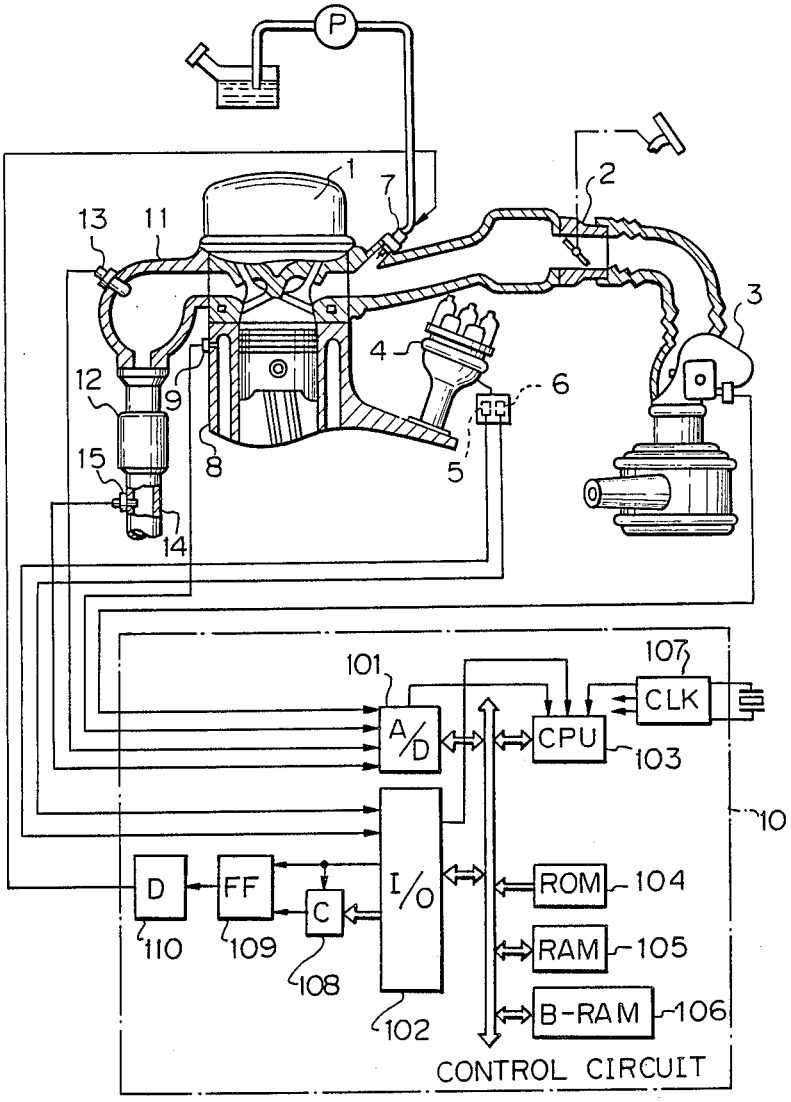
FIG. 4 is a schematic view of an internal combustion engine according to the present invention.

In FIG. 4, which illustrates an internal combustion engine according to the present invention, reference numeral 1 designates a four-cycle spark ignition engine disposed in an automotive vehicle. Provided in an air-intake passage 2 of the engine 1 is a potentiometertype airflow meter 3 for detecting the amount of air taken into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1.

In this case, the crank-angle sensor 5 generates a pulse signal at every 720° crank angle (CA) while the crank-angle sensor 6 generates a pulse signal at every 30° CA. The pulse signals of the crank angle sensors 5 and 6 are supplied to an input/output (I/O) interface 1O2 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, though not shown in FIG. 2.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits it to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_X$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit them to the A/D converter 101 of the control circuit 10.

The control circuit 10, which may be constructed by a microcomputer, further comprises a central processing unit (CPU) 103, a read-only memory (ROM) 104 for storing a main routine, interrupt routines such as a fuel injection routine, an ignition timing routine, tables (maps), constants, etc., a random access memory 105 (RAM) for storing temporary data, a backup RAM 106, an interface 102 of the control circuit 10.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is never erased even when the ignition switch (not shown) is turned off.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7.

Thus, the amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature date THW of the coolant sensor 9 are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 6, and is then stored in the RAM 105.

The operation of the control circuit 10 of FIG. 4 will be now explained.

Figures 5, 5A:
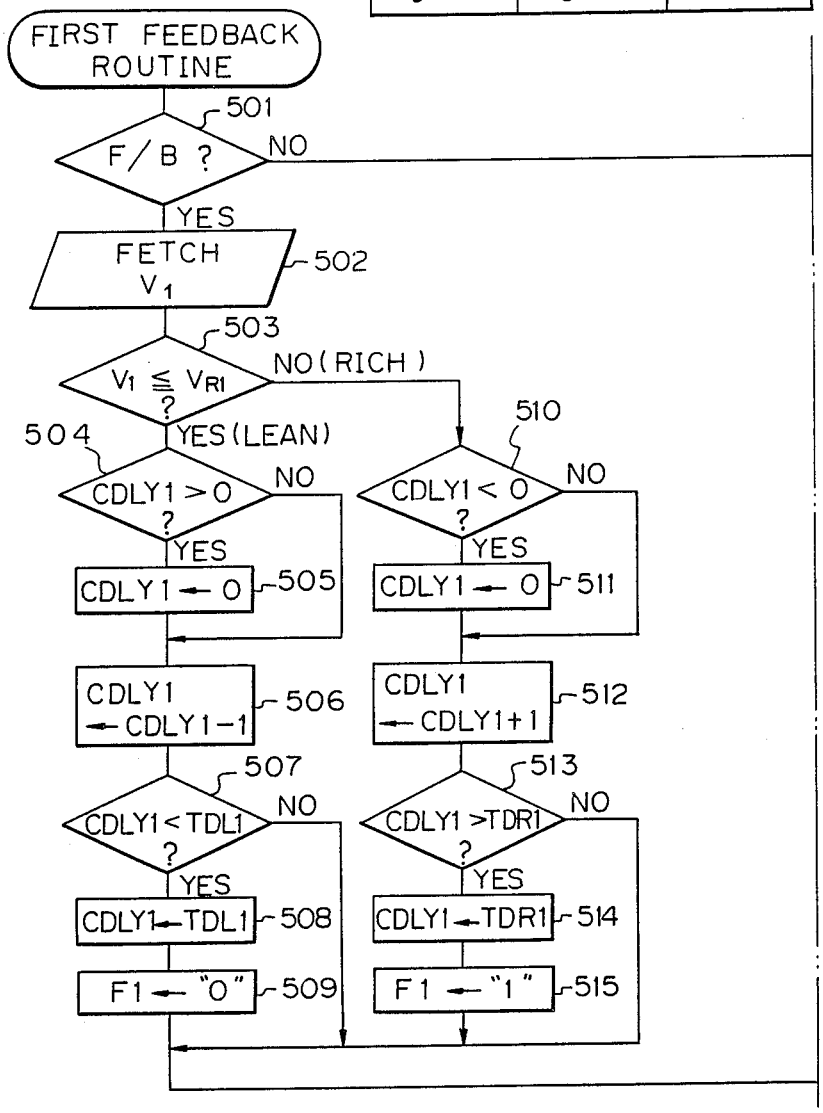
FIGS. 5, 5A–5C, 7, 7A–7C, 8, 10, 11, 13, 13A, 13B, 14, 16, and 18 are flow charts showing the operation of the control circuit of FIG. 2.
Figure 5B:
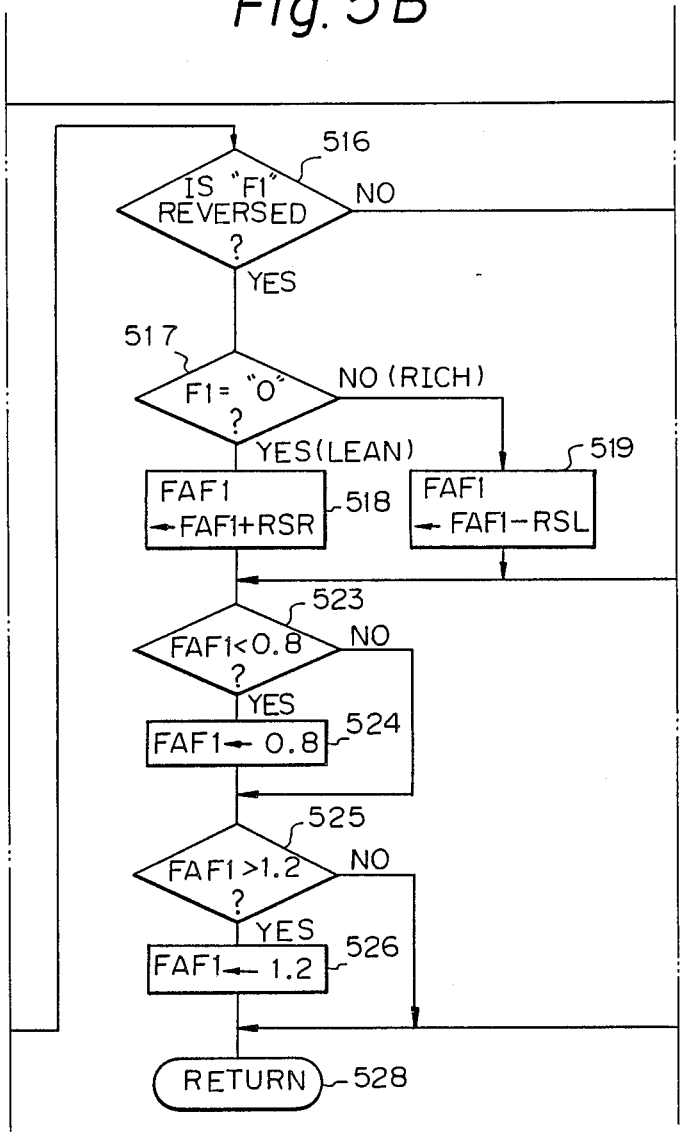
Figure 5C:
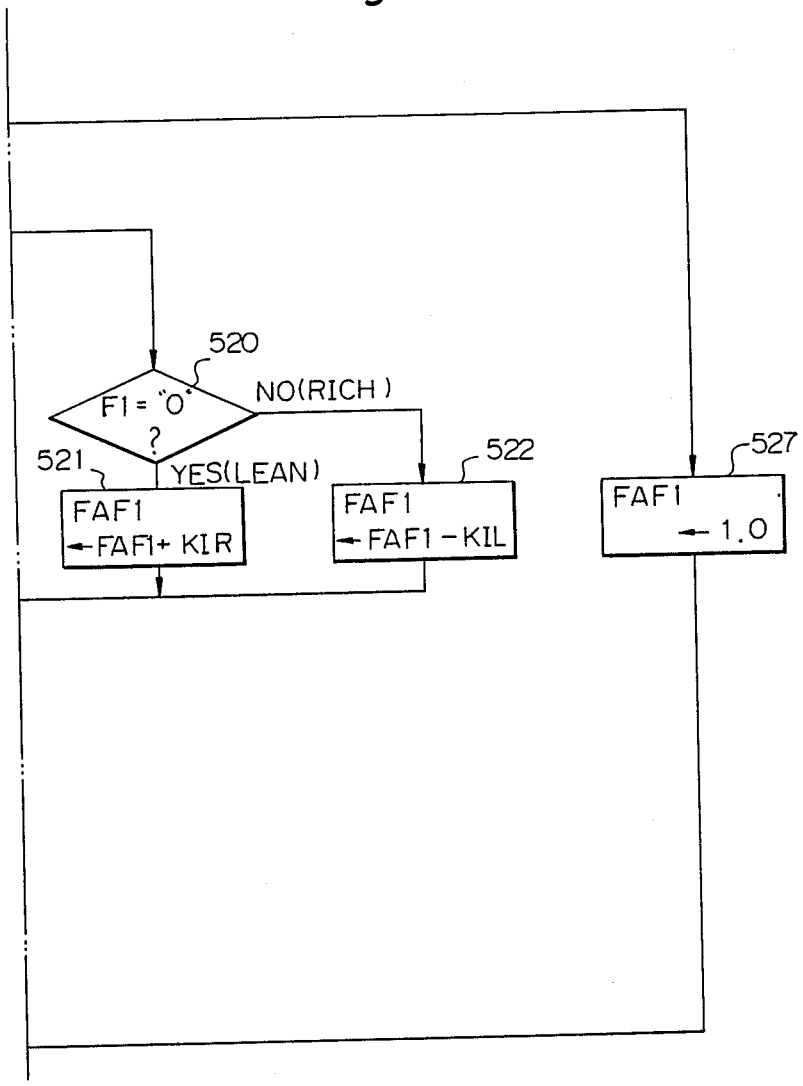

FIG. 5 is a routine for calculating a first air-fuel ratio feedback correction amount FAF1 in accordance with the output of the upstream-side $O_2$ sensor 13 executed at every predetermined time period such as 4 ms.

At step 501, it is determined whether or not all the feedback control (closed-loop control) conditions by the upstream-side $O_2$ sensor 13 are satisfied. The feedback control conditions are as follows:

(i) the engine is not in a starting state;

(ii) the coolant temperature THW is higher than 50° C.;

(iii) the power fuel incremental amount FPOWER is 0; and (iv) the upstream-side $O_2$ sensor 13 is in an activated state.

Note that the determination of activation/nonactivation of the upstream-side $O_2$ sensor 13 is carried out by determining whether or not the coolant temperature THW>70° C., or by whether or not the output of the upstream-side $O_2$ sensor 13 is once swung, i.e., once changed from the rich side to the lean side, or vice versa. Of course, other feedback control conditions are introduced as occasion demands. However, an explanation of such other feedback control conditions is omitted.

If one or more of the feedback control conditions is not satisfied, the control proceeds to step 527, in which the amount FAF1 is caused to be 1.0 (FAF1=1.0), thereby carrying out an open-loop control operation.

Contrary to the above, at step 501, if all of the feedback control conditions are satisfied, the control proceeds to step 502.

At step 502, an A/D conversion is performed upon the output voltage $V_1$ of the upstream-side $O_2$ sensor 13, and the A/D converted value thereof is then fetched from the A/D converter 101. Then at step 503,the voltage $V_1$ is compared with a reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 504, which determines whether or not the value of a first delay counter CDLY1 is positive. If CDLY1>0, the control proceeds to step 505, which clears the first delay counter CDLY1, and then proceeds to step 506. If CDLY1≦0, the control proceeds directly to step 506. At step 506, the first delay counter CDLY1 is counted down by 1, and at step 507, it is determined whether or not CDLY1<TDL1. Note that TDL1 is a lean delay time period for which a rich state is maintained even after the output of the upstream-side $O_2$ sensor 13 is changed from the rich side to the lean side, and is defined by a negative value. Therefore, at step 507, only when CDLY1<TDL1 does the control proceed to step 508, which causes CDLY1 to be TDL1, and then to step 509, which causes a first air-fuel ratio flag F1 to be "0" (lean state). On the other hand, if $V_1 > V_{R1}$, which means that the current air-fuel ratio is rich, the control proceeds to step 510, which determines whether or not the value of the first delay counter CDLY1 is negative. If CDLY1<0, the control proceeds to step 511, which clears the first delay counter CDLY1, and then proceeds to step 512. If CDLY1>0, the control directly proceeds to 512. At step 512, the first delay counter CDLY1 is counted up by 1, and at step 513, it is determined whether or not CDLY1>TDR1. Note that TDR1 is a rich delay time period for which a lean state is maintained even after the output of the upstream-side $O_2$ sensor 13 is changed from the lean side to the rich side, and is defined by a positive value. Therefore, at step 513, only when CDLY1>TDR1 does the control proceed to step 514, which causes CDLYl to be TDR1, and then to step 515, which causes the first air-fuel ratio flag F1 to be "1" (rich state).

Next, at step 516, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 517 to 519, which carry out a skip operation.

At step 517, if the flag F1 is "0" (lean) the control proceeds to step 518, which remarkably increases the correction amount FAF by a skip amount RSR. Also, if the flag F1 is "1" (rich) at step 517, the control proceeds to step 519, which remarkably decreases the correction amount FAF1 by the skip amount RSL.

On the other hand, if the first air-fuel ratio flag F1 is not reversed at step 516, the control proceeds to step 520 to 522, which carries out an integration operation. That is, if the flag F1 is "0" (lean) at step 520, the control proceeds to step 521, which gradually increases the correction amount FAF1 by a rich integration amount KIR. Also, if the flag F1 is "1" (rich) at step 520, the control proceeds to step 522, which gradually decreases the correction amount FAF1 by a lean integration amount KIL.

The correction amount FAF1 is guarded by a minimum value 0.8 at steps 523 and 524, and by a maximum value 1.2 at steps 525 and 526, thereby also preventing the controlled air-fuel ratio from becoming overrich or overlean.

The correction amount FAF1 is then stored in the RAM 105, thus completing this routine of FIG. 5 at step 528.

Figures 6A, 6B, 6C, 6D:
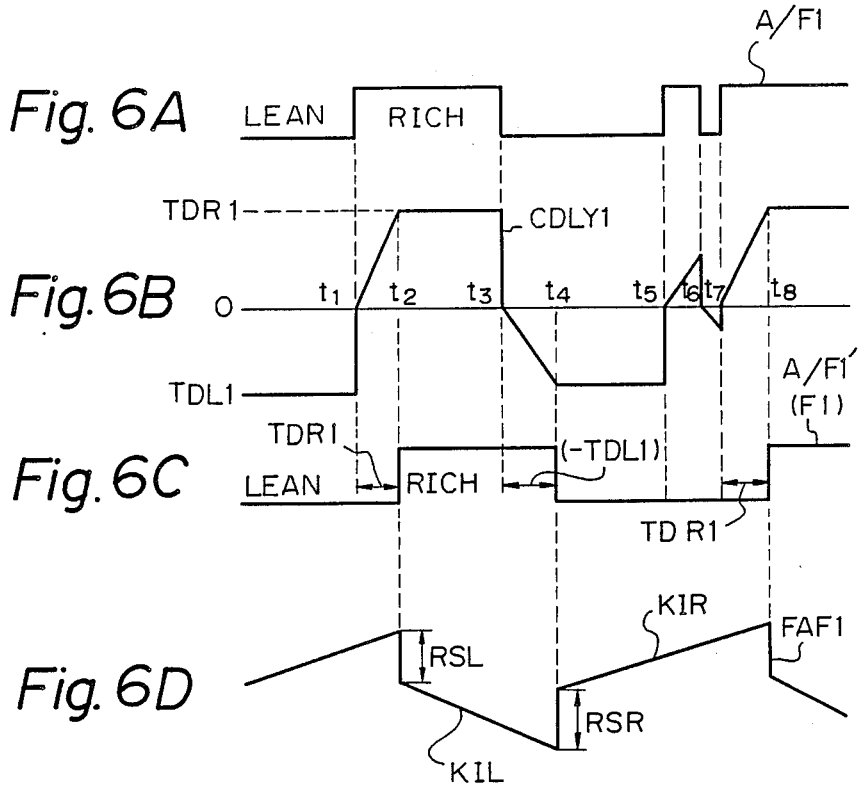
FIGS. 6A through 6D are timing diagrams explaining the flow chart of FIG. 4.

The operation by the flow chart of FIG. 5 will be further explained with reference to FIGS. 6A through 6D. As illustrated in FIG. 6A, when the air-fuel ratio A/F1 is obtained by the output of the upstream-side $O_2$ sensor 13, the first delay counter CDLY1 is counted up during a rich state, and is counted down during a lean state, as illustrated in FIG. 6B. As a result, a delayed air-fuel ratio corresponding to the first air-fuel ratio flag F1 is obtained as illustrated in FIG. 6C. For example, at time $t_1$, even when the air-fuel ratio A/F is changed from the lean side to the rich side, the delayed air-fuel ratio A/F1′ (F1) is changed at time $t_2$ after the rich delay time period TDR1. Similarly, at time $t_3$, even when the air-fuel ratio A/F1 is changed from the rich side to the lean side, the delayed air-fuel ratio F1 is changed at time $t_4$ after the lean delay time period TDL1. However, at time $t_5$, $t_6$, or $t_7$, when the air-fuel ratio A/F1 is reversed within a smaller time period than the rich delay time period TDR1 or the lean elay time period TDL1, the delay air-fuel ratio A/F1′ is reversed at time $t_8$. That is, the delayed air-fuel ratio A/F1′ is stable when compared with the air-fuel ratio A/F1. Further, as illustrated in FIG. 6D, at every change of the delayed air-fuel ratio A/F1′ from the rich side to the lean side, or vice versa, the correction amount FAF1 is skipped by the skip amount RSR or RSL, and also, the correction amount FAF1 is gradually increased or decreased in accordance with the delayed air-fuel ratio A/F1′.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side $O_2$ sensor 13 is variable. Further, as the air fuel ratio feedback control parameter, there are nominated a delay time period TD (in more detail, the rich delay time period TDR1 and the lean delay time period TDL1), a skip amount RS (in more detail, the rich skip amount RSR and the lean skip amount RSL), an integration amount KI (in more detail, the rich integration amount KIR and the lean integration amount KIL), and the reference voltage $V_{R1}$.

For example, if the rich delay time period becomes larger than the lean delay time period (TDR1>(−TDL1)), the controlled air-fuel ratio becomes richer, and if the lean delay time period becomes larger than the rich delay time period ((−TDL1)>TDR1), the controlled air-fuel ratio becomes leaner. Thus, the air-fuel ratio can be controlled by changing the rich delay time period TDR1 and the lean delay time period (−TDL1) in accordance with the output of the downstream-side $O_2$ sensor 15. Also, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output of the down stream-side $O_2$ sensor 15. Further, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15. Still further, if the reference voltage $V_{R1}$ is increased, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the downstream-side $O_2$ sensor 15.

A double $O_2$ sensor system into which a second air-fuel ratio correction amount FAF2 is introduced will be explained with reference to FIGS. 7, 8, 10, and 11.

Figures 7, 7A:
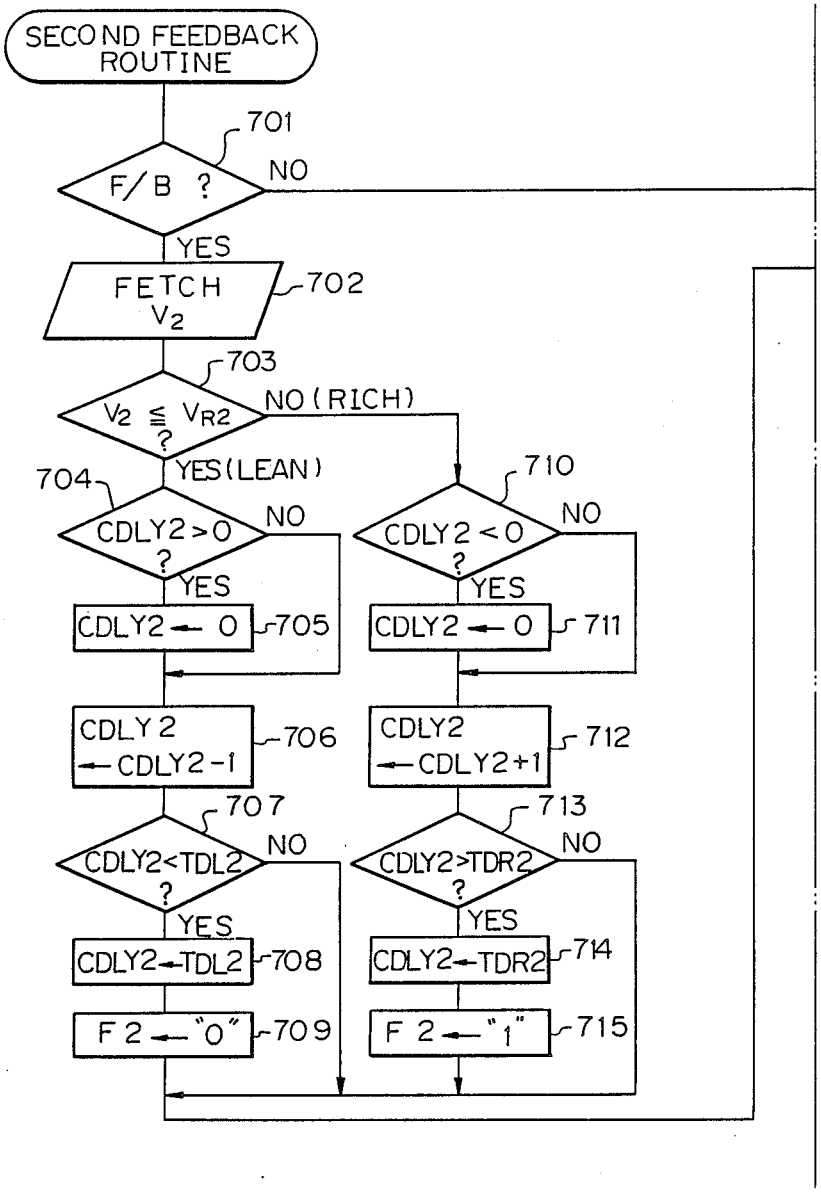
Figure 7B:
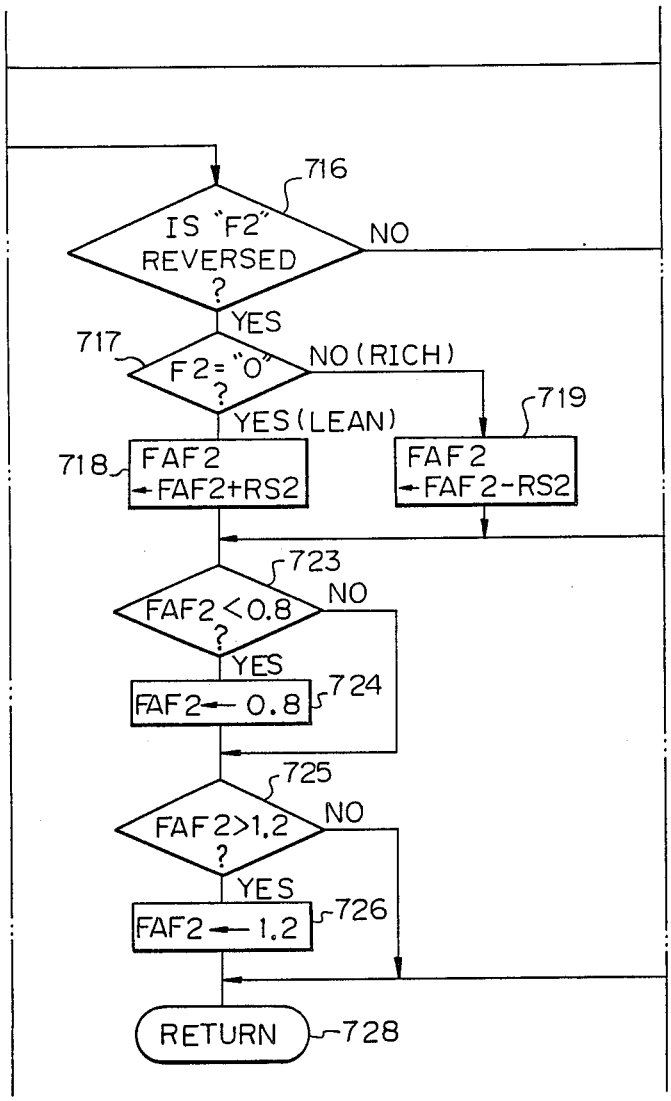
Figure 7C:
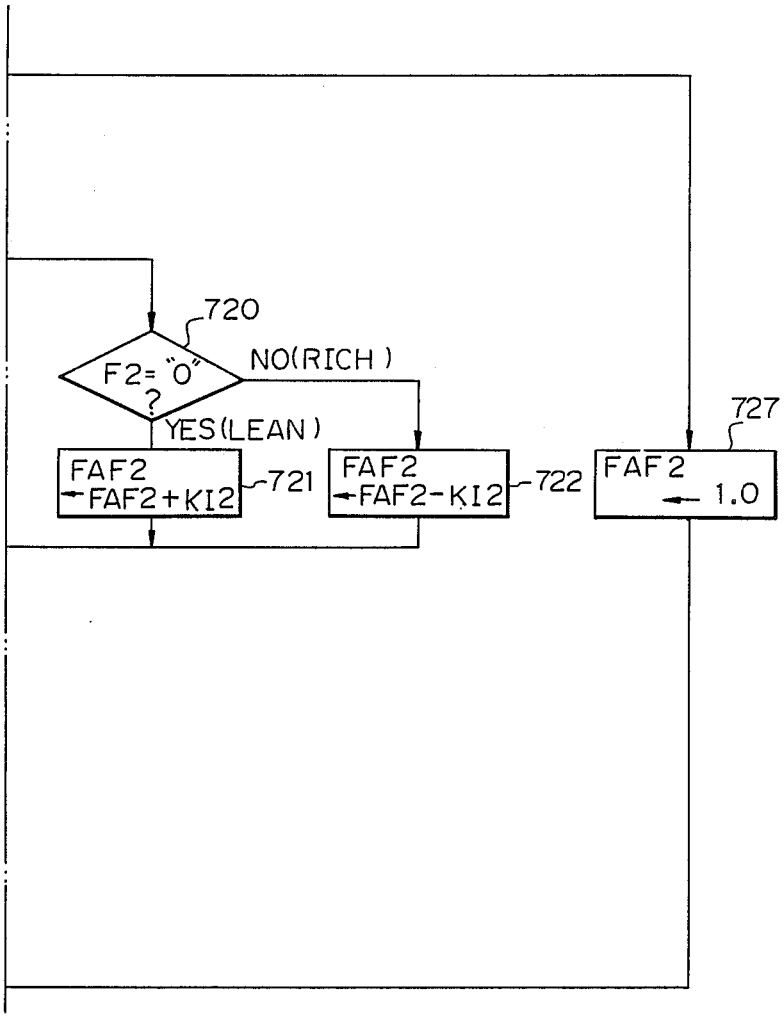

FIG. 7 is a routine for calculating a second air-fuel ratio feedback correction amount FAF2 in accordance with the output of the downstream-side $O_2$ sensor 15 executed at every predetermined time period such as 1 s.

At step 701, it is determined all the feedback control (closed-loop control) conditions by the downstream-side $O_2$ sensor 15 are satisfied. The feedback control conditions are as follows:

(i) the engine is not in a starting state;

(ii) the coolant temperature THW is higher than 50° C.; and (iii) the power fuel incremental amount FPOWER is 0.

Of course, other feedback control conditions are introduced as occasion demands. However, an explanation of such other feedback control conditions is omitted.

If one or more of the feedback control conditions is not satisfied, the control also proceeds to step 727, thereby carrying out an open-loop control operation.

Contrary to the above, at step 701, if all of the feedback control conditions are satisfied, the control proceeds to step 702.

At step 702, an A/D conversion is performed upon the output voltage $V_2$ of the downstream-side $O_2$ sensor 15, and the A/D converted value thereof is then fetched from the A/D converter 101. Then, as step 703, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (=0.55 V) is preferably higher that the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12.

Steps 704 through 715 correspond to step 504 through 515, respectively, of FIG. 5, thereby performing a delay operation upon the determination at step 703. Here, a rich delay time period is defined by TDR2, and a lean delay time period is defined by TDL2. As a result of the delayed determination, if the air-fuel ratio is rich a second air-fuel ratio flag F2 is caused to be "1", and if the air-fuel ratio is lean, a second air-fuel ratio flag F2 is caused to be "0".

Next, at step 716, it is determined whether or not the second air-fuel ratio flag F2 is reversed, i.e., whether or not the delayed air-fuel ratio detected by the downstream-side $O_2$ sensor 15 is reversed. If the second air-fuel ratio flag F2 is reversed, the control proceeds to steps 717 to 719 which carry out a skip operation. That is, if the flag F2 is "0" (lean) at step 717, the control proceeds to step 718, which remarkably increases the second correction amount FAF2 by skip amount RS2. Also, if the flag F2 is "1" (rich) at step 717, the control proceeds to step 719, which remarkably decreases the second correction amount FAF2 by the skip amount RS2. On the other hand, if the second air-fuel ratio flag F2 is not reversed at step 716, the control proceeds to steps 720 to 722, which carries out an integration operation. That is, if the flag F2 is "0" (lean) at step 720, the control proceeds to step 721, which gradually increases the second correction amount FAF2 by an integration amount KI2. Also, if the flag F2 is "1" (rich) at step 720, the control proceeds to step 722, which gradually decreases the second correction amount FAF2 by the integration amount KI2.

Note that the skip amount RS2 is larger than the interation amount KI2.

The second correction amount FAF2 is guarded by a minimum value 0.8 at steps 723 and 724, and by a maximum value 1.2 at steps 725 and 726, thereby also preventing the controlled air-fuel ratio from becoming overrich or overlean.

The correction amount FAF2 is then stored in the RAM 105, thus completing this routine of FIG. 7 at step 728.

Figure 8:
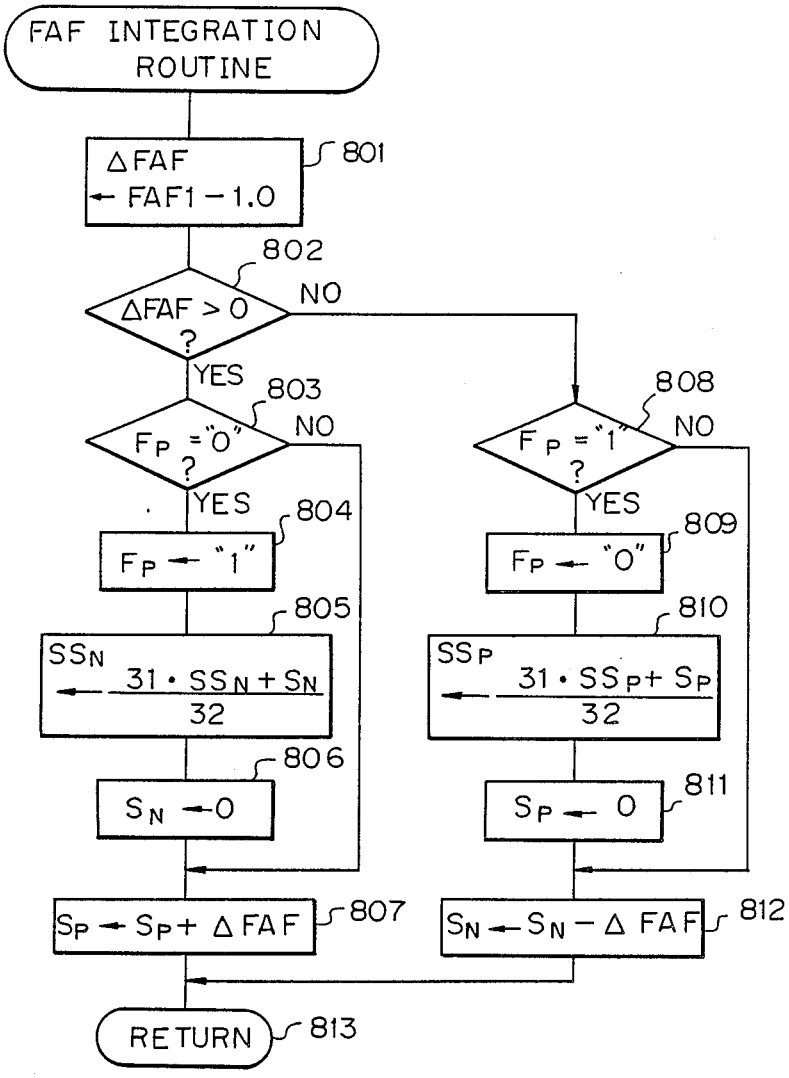

FIG. 8 is a routine for calculating an integration amount FAFAV of the first air-fuel ratio correction coefficient FAF1 executed at every relatively short time period such as 4 ms. Note that a positive integration amount Sp and a blunt valued thereof, and a negative integration amount $S_N$ and blunt value thereof are initially cleared by the initial routine, which is not shown. At step 801, a difference ΔFAF between the first air-fuel ratio correction coefficient FAF1 and the reference value (=1.0), which corresponds to the value of the first air-fuel ratio correction coefficient FAF1 during an open-loop control, is calculated by:

$$\Delta FAF \leftarrow FAF1 - 1.0$$

Then, at step 802, it is determined whether or not $\Delta FAF > 0$ is satisfied. As a result, if $\Delta FAF > 0$, the control proceeds to steps 803 through 807, but if $\Delta FAF \leqq 0$ the control proceeds to steps 808 through 812.

At step 803, it is determined whether or not a flag $F_P$ is "0". Note that the flag $F_P$ (="1") indicates a state where $\Delta FAF > 0$. Therefore, if immediately before time $t_2$ in FIG. 9, $F_P$="0", the control proceeds to step 804 which sets the flag $F_P$(="1"), and at step 805, the blunt value $SS_N$ of the negative integration amount $S_N$ is calculated by:

$$SS_N \leftarrow \frac{31 \cdot SS_N + S_N}{32}$$

where $S_N$ is the negative integration amount from time $t_1$ to time $t_2$ of FIG. 9. Then, at step 806, the negative integration amount $S_N$ is cleared. At step 807, the positive integration amount $S_P$ is accumulated by:

$$S_p \leftarrow S_p + \Delta FAF.$$

Thus, this routine is completed by step 813.

From time $t_2$ to time $t_3$ of FIG. 9, since $\Delta FA > 0$, the flow at step 803 proceeds directly to step 807 which also accumulates the positive integration amount $S_p$.

At time $t_3$ of FIG. 9, the flow from step 802 to step 803 is switched to the flow from step 802 to step 808. As a result, the flag $F_P$ is cleared by steps 808 and 809. Then, at step 810, the blunt value $SS_p$ of the positive integration amount $S_p$ is calculated by:

$$SS_P \leftarrow \frac{31 \cdot SS_P + S_P}{32}$$

Where $S_p$ is the positive integration amount from time $t_2$ to time $t_3$ of FIG. 9. Then, at step 811, the negative integration amount $S_p$ is cleared. At step 912, the positive integration $S_p$ is accumulated by:

$$S_N \leftarrow S_N - \Delta FAF$$

Note that the blunt ratio (31/1) at steps 805 and 810 can be another ratio. Also, a mean value of a number of successive positive integration amounts $S_p$ and a mean value of a number of successive negative integration amounts $S_N$ can be used for the blunt values $SS_p$ and $SS_N$, respectively. Further, the values $S_p$ and $S_N$ can be used directly for the values $S_{pp}$ and $S_{NN}$, respectively. In this case, at steps 805 and 810, $$SS_N \leftarrow S_N$$

$$SS_{PP} \leftarrow S_P.$$

Figure 10:
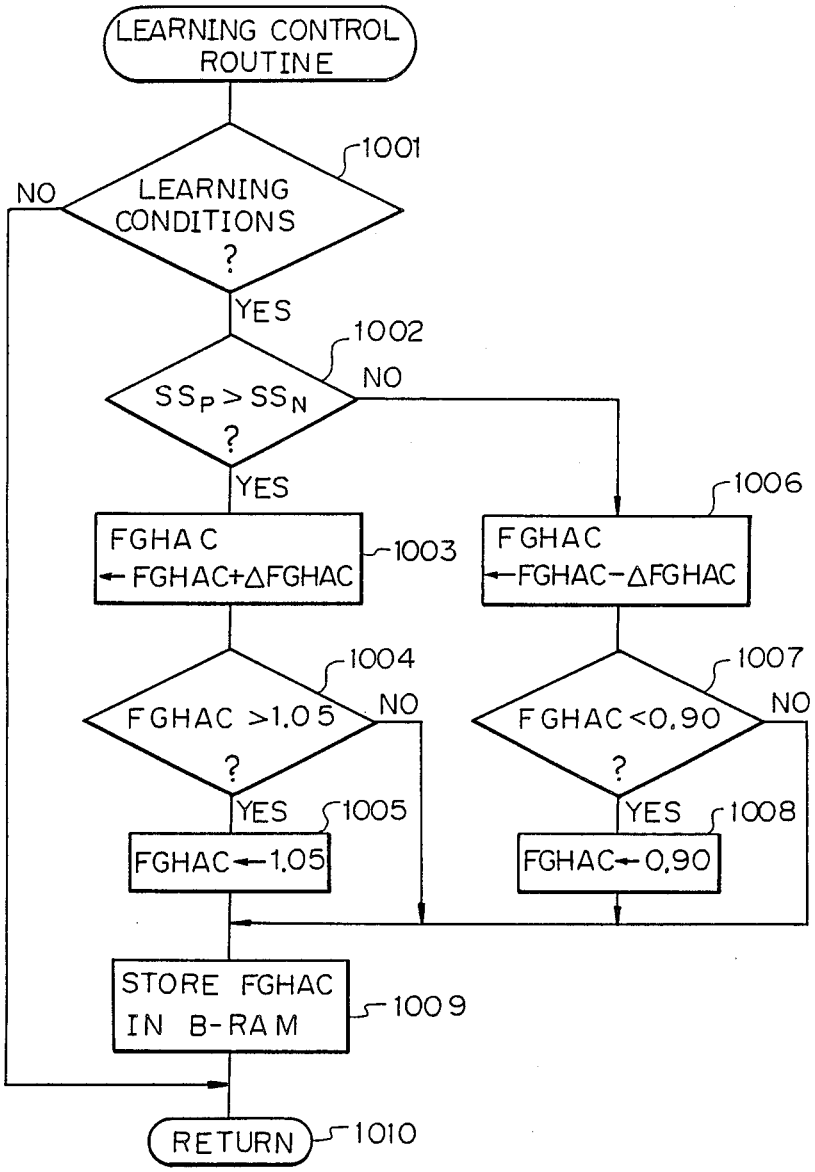

FIG. 10 is a learning control routine for calculating a learning correction amount FGHAC executed at every relatively long time period such as 512 ms (or at every 10 skip operations). At step 1001, it is determined whether or not all the learning control conditions are satisfied. The learning control conditions are as follows:

(i) the coolant temperature THW is higher than 70° C. and lower than 90° C.; and (ii) the deviation ΔQ of the intake air amount is smaller than a predetermined value.

Of course, other learning control conditions are also introduced as occasion demands. If one or more of the learning control conditions are not satisfied, the control proceeds directly to step 1010, and if all the learning control conditions are satisfied, the control proceeds to step 1002 which carries out a learning control operation. That is, at step 1002, it is determined whether the blunt value $SS_p$ of the positive integration amount $S_p$ is larger than the blunt value $SS_N$ of the negative integration amount $S_N$. As a result, if $SS_p > SS_N$, the control proceeds to step 1003, which increases the learning correction amount FGHAC by ΔFGHAC (definite value), and at steps 1004 and 1005, the learning correction amount FGHAC is guarded by a maximum value 1.05. On the other hand, if $SS_p \geqq SS_N$, the control proceeds to step 1006, which decreases the learning correction amount FGHAC by ΔFGHAC (definite value), and at steps 1007 and 1008, the learning correction amount FGHAC is guarded by a minimum value 0.90.

Then, at step 1009, the learning correction amount FGHAC is stored in the backup RAM 106, and this routine is completed by step 1010.

Figure 11:
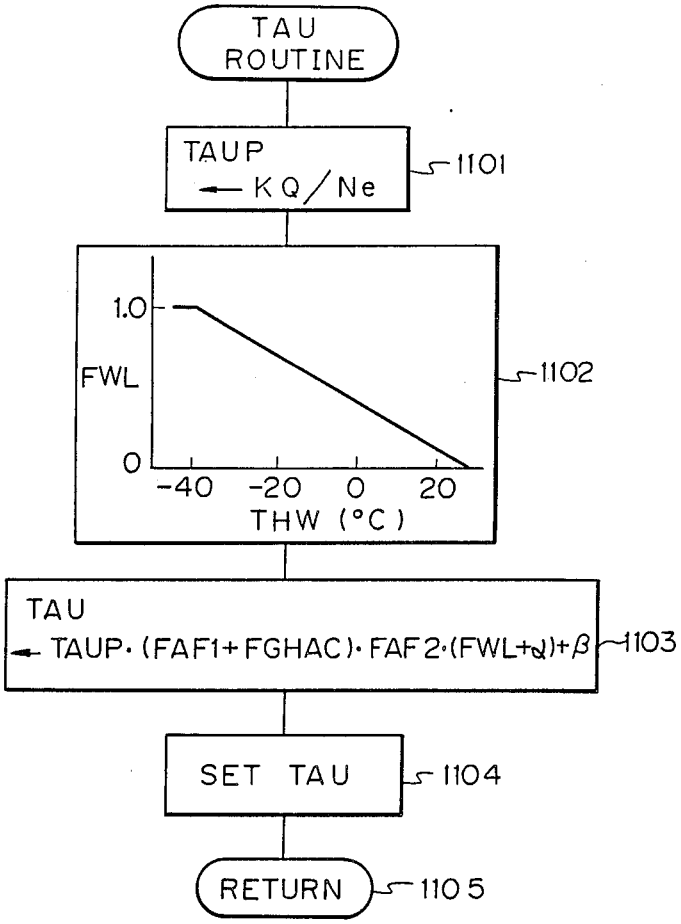

FIG. 11 is a routine for calculating a fuel injection amount TAU executed at every predetermined crank angle such as 360° CA. At step 1101, a base fuel injection amount TAUP is calculated by using the intake air amount data Q and the engine speed data Ne stored in the RAM 105. That is, $$TAUP \leftarrow KQ/Ne$$

where K is a constant. Then at step 1102, a warming-up incremental amount FWL is calculated from a one-dimensional map stored in the ROM 104 by using the coolant temperature data THW stored in the RAM 105. Note that the warming-up incremental amount FWL decreases when the coolant temperature THW increases. At step 1103, a final fuel injection amount TAU is calculated by $$TAU \leftarrow TAUP \cdot (FAF1 + FGHAC) \cdot FAF2 \cdot (FWL + \alpha) + \beta$$

where $\alpha$ and $\beta$ are correction factors determined by other parameters such as the voltage of the battery and the temperature of the intake air. At step 1104, the final fuel injection amount TAU is set in the down counter 107, and in addition, the flip-flop 108 is set initiate the activation of the fuel injection valve 7. Then, this routine is completed by step 1105. Note that, as explained above, when a time period corresponding to the amount TAU passes, the flip-flop 109 is reset by the carry-out signal of the down counter 108 to stop the activation of the fuel injection valve 7.

Figures 12A, 12B, 12C, 12D, 12E, 12F, 12G, 12H:
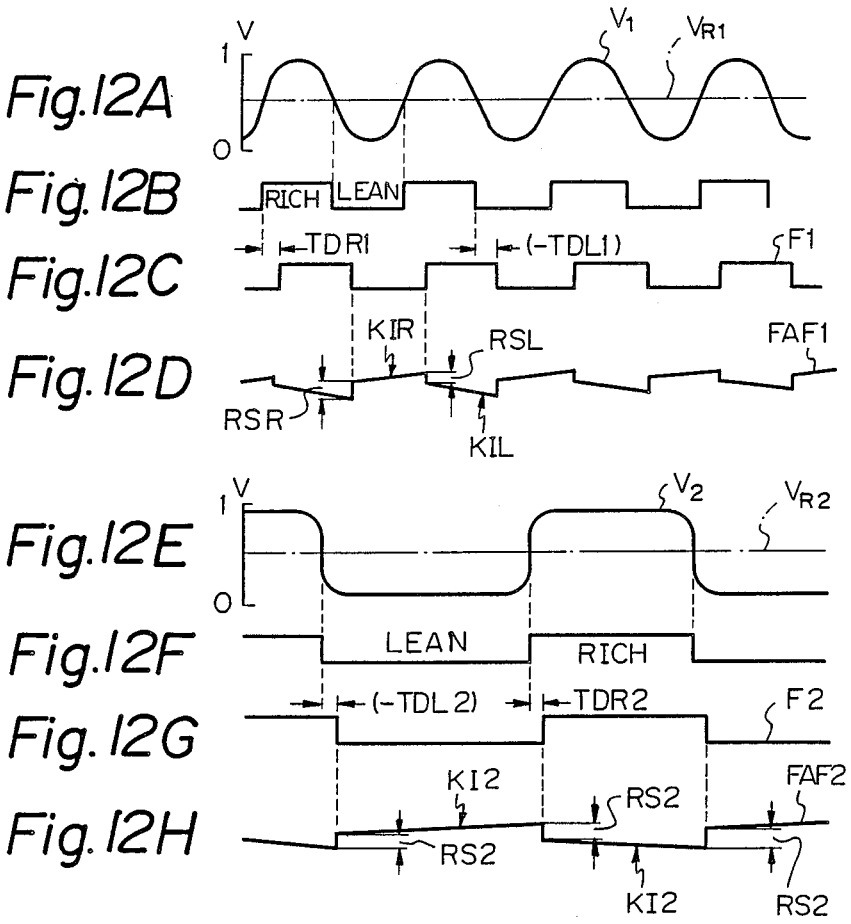
FIGS. 12A through 12H are timing diagrams explaining the flow charts of FIGS. 5, 5A–5C, 7, 7A–7C, 8, 10, 13, 13A, 13B and 14.

FIGS. 12A through 12H are timing diagrams for explaining the two air-fuel ratio correction amounts FAF1 and FAF2 obtained by the flow charts of FIGS. 5, 7, 8, 10. and 11. In this case, the engine is in a closed-loop control state for the two $O_2$ sensors 13 and 15. When the output of the upstream-side $O_2$ sensor 13 is changed as illustrated in FIG. 12A, the determination at step 503 of FIG. 5 is shown in FIG. 12B, and a delayed determination thereof corresponding to the first air-fuel ratio flag F1 is shown in FIG. 12C. As a result, as shown in FIG. 12D, every time the delayed determination is changed from the rich side to the lean side, or vice versa, the first air-fuel ratio correction amount FAF1 is skipped by the amount RSR or RSL. On the other hand, when the output of the downstream-side $O_2$ sensor 15 is changed as illustrated in FIG. 12E, the determination at step 703 of FIG. 7 is shown in FIG. 12F, and the delayed determination thereof corresponding to the second air-fuel ratio flag F2 is shown in FIG. 12G. As a result, as shown in FIG. 12H, every time the delayed determination is changed from the rich side to the lean side, or vice versa, the second air-fuel ratio correction amount FAF2 is skipped by the skip amount RS2.

A double $O_2$ sensor system, in which an air-fuel ratio feedback control parameter of the first air-fuel ratio feedback control by the upstream-side $O_2$ sensor is variable, will be explained with reference to FIGS. 13 and 14. In this case, the skip amounts RSR and RSL as the air-fuel ratio feedback control parameters are variable.

Figures 13, 13A:
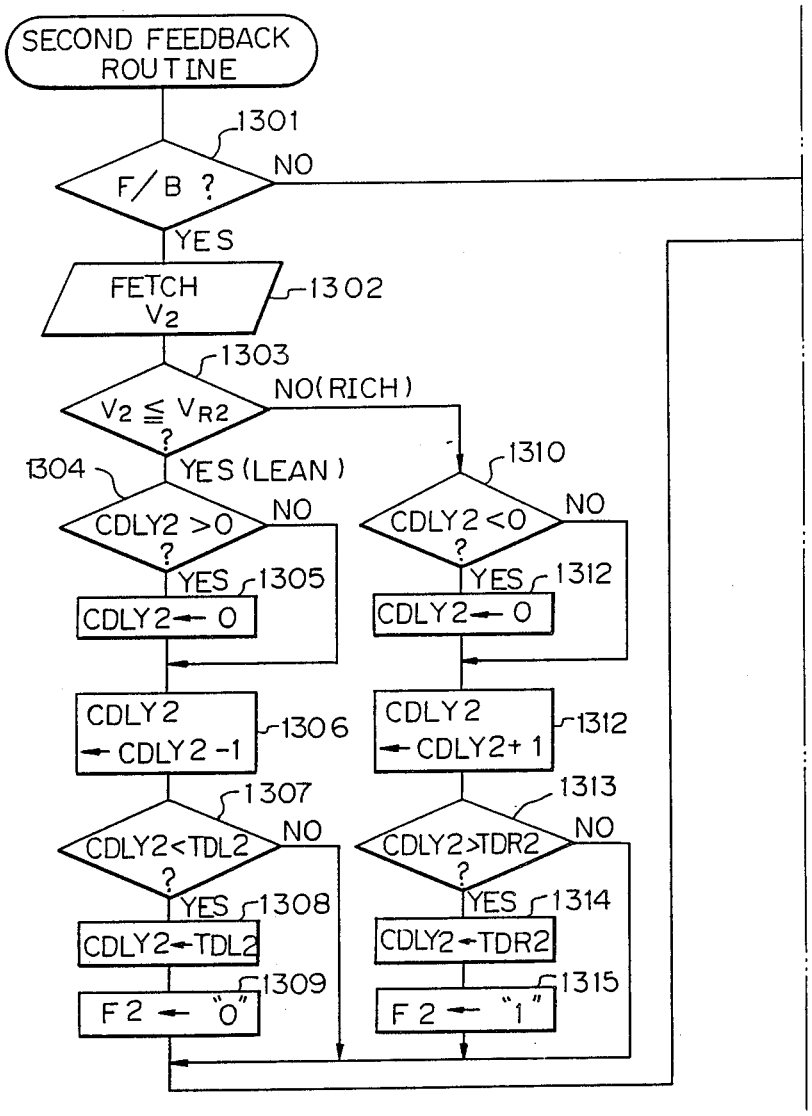
Figure 13B:
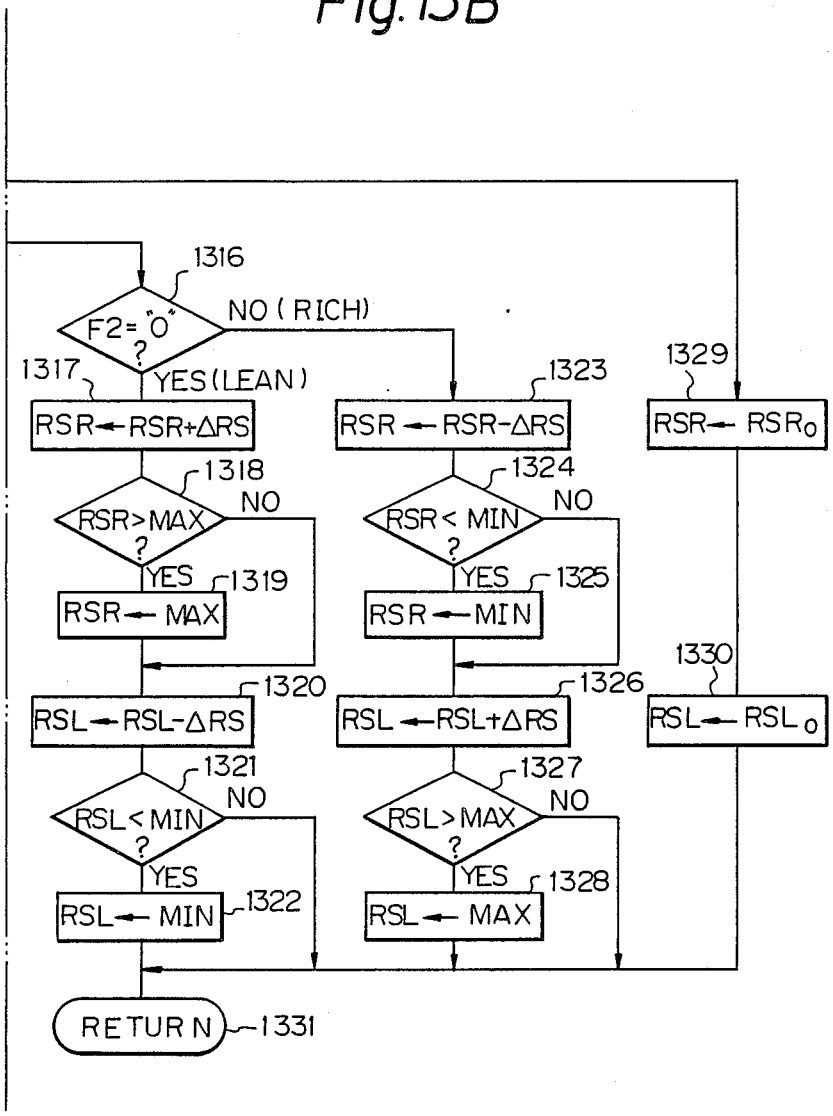

FIG. 13 is a routine for calculating the skip amounts RSR and RSL in accordance with the output of the downstream-side $O_2$ sensor 15 executed at every predetermined time period such as 1 s.

Steps 1301 through 1315 are the same as steps 701 through 715 of FIG. 7. That is, if one or more of the feedback control conditions is not satisfied, the control proceeds to steps 1329 and 1330, thereby carrying out an open-loop control operation. For example, the rich skip amount RSR and the lean skip amount RSL are made definite values $RSR_0$ and $RSL_0$ which are, for example, 5%. Also, note that the amounts RSR and RSL can be values stored in the backup RAM 106.

Contrary to the above, if all of the feedback control conditions are satisfied, the second air-fuel ratio flag F2 is determined by the routine of steps 1302 through 1315.

At step 1316, it is determined whether or not the second air-fuel ratio F2 is "0". If F2="0", which means that the air-fuel ratio is lean, the control proceeds to steps 1317 through 1322, and if F2="1", which means that the air-fuel ratio is rich, the control proceeds to step 1323 through 1328.

At step 1317, the rich skip amount RSR is increased by a definite value $\Delta RS$ which is, for example, 0.08, to move the air-fuel ratio to the rich side. At steps 1318 and 1319, the rich skip amount RSR is guarded by a maximum value MAX which is, for example, 6.2%. Further, at step 1320, the lean skip amount RSL is decreased by the definite value $\Delta RS$ to move the air-fuel ratio to the lean side. At steps 1321 and 1322, the lean skip amount RSL is guarded by a minimum value MIN which is, for example 2.5%.

On the other hand, at step 1323, the rich skip amount RSR is decreased by the definite value $\Delta RS$ to move the air-fuel ratio to the lean side. At steps 1324 and 1325, the rich skip amount RSR is guarded by the minimum value MIN. Further, at step 1326, the lean skip amount RSL is decreased by the definite value $\Delta RS$ to move the air-fuel ratio to the rich side. At steps 1327 and 1328, the lean skip amount RSL is guarded by the maximum value MAX.

The skip amounts RSR and RSL are then stored in the RAM 105, thereby completing this routine of FIG. 13 at step 1331.

Thus, according to the routine of FIG. 13, when the delayed output of the second $O_2$ sensor 15 is lean, the rich skip amount RSR is gradually increased, and the lean skip amount RSL is gradually decreased, thereby moving the air-fuel ratio to the rich side. Contrary to this, when the delayed output of the second $O_2$ sensor 15 is rich, the rich skip amount RSR is gradually decreased, and the lean skip amount RSL is gradually increased, thereby moving the air-fuel ratio to the lean side.

Figure 14:
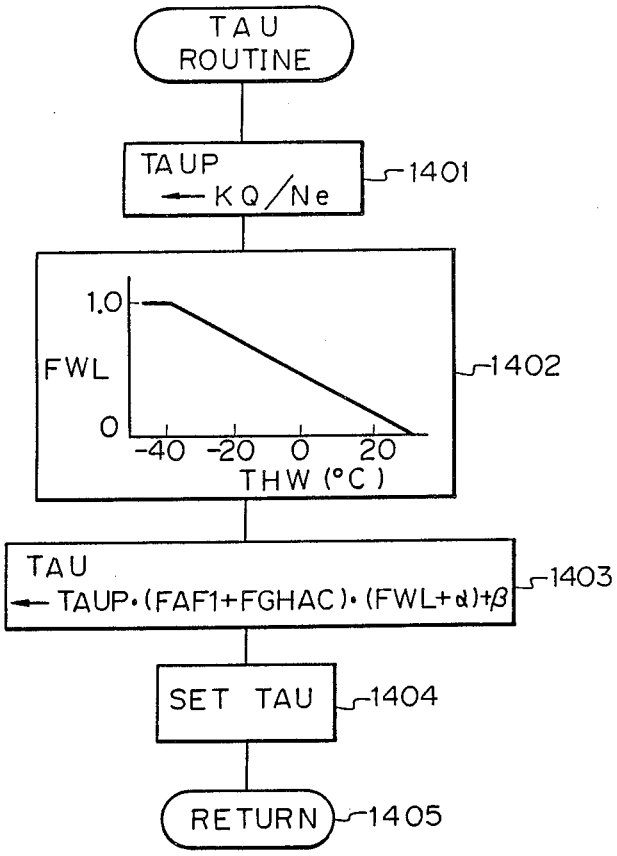

FIG. 14 is a routine for calculating a fuel injection amount TAU executed at every predetermined crank angle such as 360° CA. At step 1401, a base fuel injection amount TAUP is calculated by using the intake air amount data Q and the engine speed data Ne stored in the RAM 105. That is, $$TAUP \leftarrow K \cdot Q/Ne$$

where K is a constant. Then at step 1402, a warming-up incremental amount FWL is calculatedffrom a one-dimensional map by using the coolant temperature data THW stored in the RAM 105. Note that the warming-up incremental amount FWL decreases when the coolant temperature THW increases. At step 1403, a final fuel injection amount TAU is calculated by $$TAU \leftarrow TAUP \cdot (FAF1 + FGHAC) \cdot (FWL + \alpha) + \beta$$

where $\alpha$ and $\beta$ are correction factors determined by other parameters such as the voltage of the battery and the temperature of the intake air. At step 1404, the final fuel injection amount TAU is set in the down counter 108, and in addition, the flip-flop 109 is set to initiate the activation of the fuel injection valve 7. Then, this routine is completed by step 1405. Note that, as explained above, when a time period corresponding to the amount TAU has passed, the flip-flop 109 is reset by the carry-out signal of the down counter 108 to stop the activation of the fuel injection valve 7.

Figures 15A, 15B, 15C, 15D, 15E, 15F, 15G, 15H, 15I:
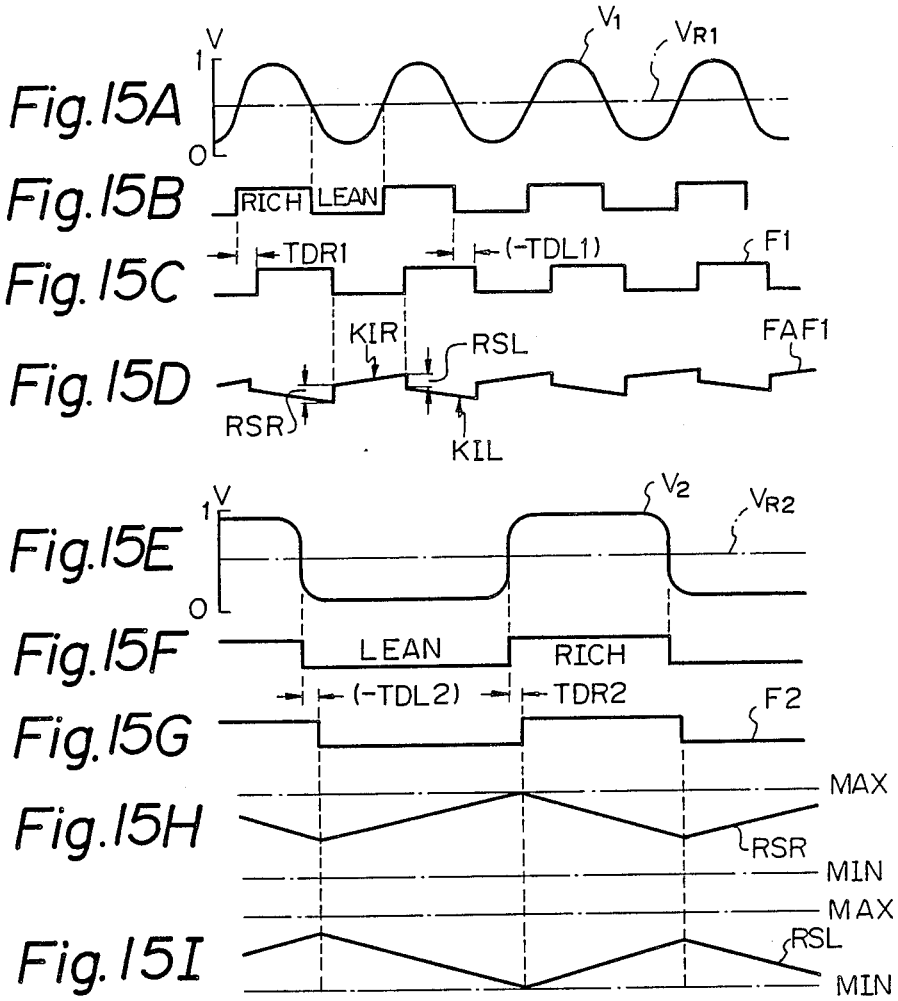
FIGS. 15A through 15I are timing diagrams explaining the flow charts of FIGS. 5, 5A–5C, 8, 10, 13, 13A, 13B and 14.

FIGS. 15A through 15I are timing diagrams for explaining the air-fuel ratio correction amount FAF1 and the skip amounts RSR and RSL obtained by the flow charts of FIGS. 5, 8, 10, 13, and 14. FIGS. 15A through 15G are the same as FIGS. 12A through l2G, respectively. As shown in FIGS. 15H and 15I, when the delayed determination F2 is lean, the rich skip amount RSR is increased and the lean skip amount RSL is decreased, and when the delayed determination F2 is rich, the rich skip amount RSR is decreased and the lean skip amount RSL is increased. In this case, the skip amounts RSR and RSL are changed within a range from MAX to MIN.

Note that the calculated parameters FAF1 and FAF2, or FAF1, RSR, and RSL can be stored in the backup RAM 106, thereby improving drivability at the re-starting of the engine.

Figure 16:
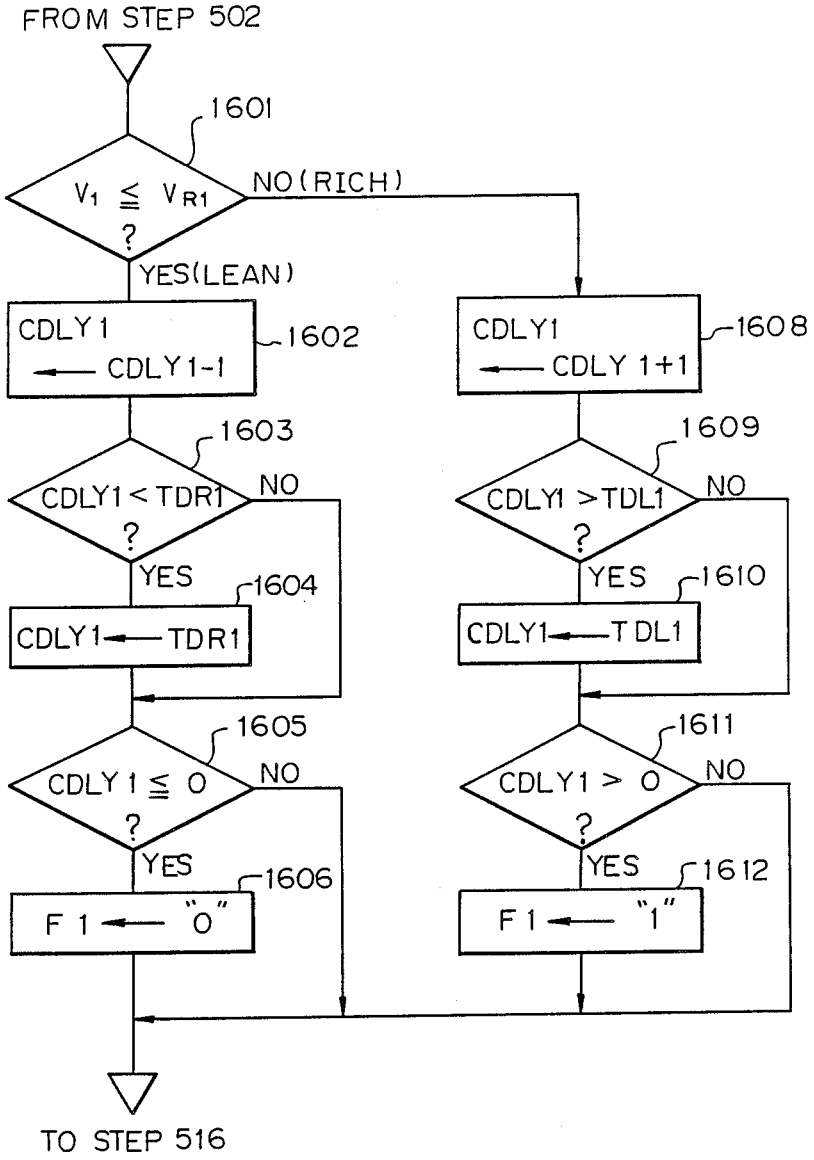

In FIG. 16, which is a modification of FIG. 5, a delay operation different from the FIG. 5 is carried out. That is, at step 1601, if $V_1 \leqq V_{R1}$, which means that the current air-fuel ratio is lean, the control proceeds to steps 1602 which decreases a first delay counter CDLY1 by 1. Then, at steps 1603 and 1604, the first delay counter CDLY1 is guarded by a minimum value TDR1. Note that TDR1 is a rich delay time period for which a lean state is maintained even after the output of the upstream-side $O_2$ sensor 13 is changed from the lean side to the rich side, and is defined by a negative value.

Note that, in this case, if CDLY1>0, then the delayed air-fuel ratio is rich, and if CDLY1≦0, then the delayed air-fuel ratio is lean.

Therefore, at step 1605, it is determined whether or not CDLY≦0 is satisfied. As a result, if CDLY1<0, at step 1606, the first air-fuel ratio flag F1 is caused to be "0" (lean). Otherwise, the first air-fuel ratio flag F1 is unchanged, that is, the flag F1 remains at "1".

On the other hand, if $V_1 > V_{Rl}$, which means that the current air-fuel ratio is rich, the control proceeds to step 1608 which increases the first delay counter CDLY1 by 1. Then, at steps 1609 and 1610, the first delay counter CDLY1 is guarded by a maximum value TDL1. Note that TDL1 is a lean delay time period for which a rich state is maintained even after the output of the upstream-side $O_2$ sensor 13 is changed from the rich side to the lean side, and is defined by a positive value.

Then, at step 1611, it is determined whether of not CDLY1>0 is satisfied. As a result, if CDLY1>0, at step 1612, the first air-fuel ratio flag F1 is caused to be "1" (rich). Otherwise, the first air-fuel ratio flag F1 is unchanged, that is, the flag F1 remains at "0".

The operation by the flow chart of FIG. 16 will be further explained with reference to FIGS. 17A through 17D. As illustrated in FIGS. 17A, when the air-fuel ratio A/F1 is obtained by the output of the upstream-side $O_2$ sensor 13, the first delay counter CDLY1 is counted up during a rich state, and is counted down during a lean state, as illustrated in FIG. 17B. As a result, the delayed air-fuel ratio A/F1' is obtained as illustrated in FIG. 17C. For example, at time $t_1$, even when the air-fuel ratio A/F1 is changed from the lean side to the rich side, the delayed air-fuel ratio A/F1 is changed at time $t_2$ after the rich delay time period TDR1. Similarly, at time $t_3$, even when the air-fuel ratio A/F1 is changed form the rich side to the lean side, the delayed air-fuel ratio A/F1' is changed at time $t_4$ after the lean delay time period TDL1. However, at time $t_5$, $t_6$, or $t_7$, when the air-fuel ratio A/F is reversed within a smaller time period than the rich delay time period TDR1 or the lean delay time period TDL1, the delayed air-fuel ratio A/F1' is reversed at time $t_8$. That is, the delayed air-fuel ratio A/F1' is stable when compared with the air-fuel ratio A/F1. Further, as illustrated in FIG. 17D, at every change of the delayed air-fuel ratio A/F1' from the rich side to the lean side, or vice versa, the correction amount FAF1 is skipped by the skip amount RSR or RSL, and also, the correction amount FAF1 is gradually increased or decreased in accordance with the delayed air-fuel ratio A/F1'.

Note that, in this case, during an open-control mode, the rich delay time period TDR1 is, for example, −12 (48 ms), and the lean delay time period TDL1 is, for example, 6 (24 ms).

Figure 18:
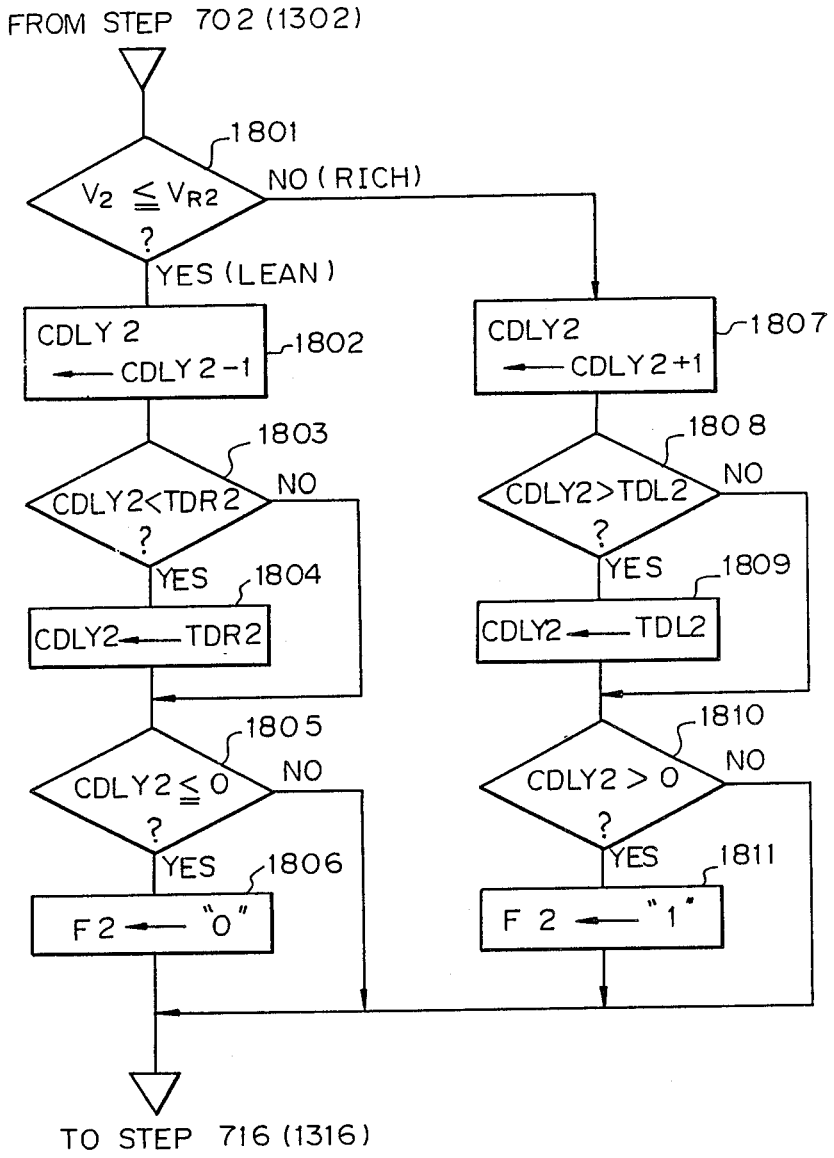

In FIG. 18, which is a modification of FIGS. 7 or 13, the same delay operation as in FIG. 16 is carried out, and therefore, a detailed explanation thereof is omitted.

Also, the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. That is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the integration amounts KIR and KIL, the delay time periods TDR1 and TDL1, or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is cotrolled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 1101 of FIG. 11 or at step 1401 or FIG. 4 is determined by the carburetor itself, i.e., the intake air negative pressure and the engine speed, and the air amount corresponding to TAU at step 1103 of FIG. 11 or at step 1403 of FIG. 4.

Further, a CO sensor, a lean-mixture sensor or the like can be also used instead of the $O_2$ sensor.

As explained above, according to the present invention, since a learning control operation is carried out in accordance with the integration amount FAFAV, an exact learning correction amount FGHAC can be obtained even when the air-fuel ratio feedback control parameters such as RSR and RSL are asymmetrical, i.e., even when the first air-fuel ratio correction amount FAF1 is asymmetrically changed with respect to the mean value thereof. Thus, during an open-loop control or during a transient mode, the fuel consumption, the drivability, and the condition of the emissions can be improved.

We claim:

1. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

calculating an air-fuel ratio correction amount in accordance with the output of said upstream-side air-fuel ratio sensor;

calculating an integration amount of said air-fuel ratio correction amount;

calculating a learning correction amount so that the integration amount of said air-fuel ratio correction amount is brought close to a reference value; and adjusting an actual air-fuel ratio in accordance with said air-fuel ratio correction amount, said learning correction amount, and the output of said downstream-side air-fuel ratio sensor;

said method further comprising a step of calculating an air-fuel ratio feedback control parameter in accordance with the output of said downstream-side air-fuel ratio sensor;

said air-fuel ratio correction amount calculating step calculating said air-fuel ratio correction amount in accordance with the output of said upstream-side air-fuel ratio sensor and said air-fuel ratio feedback control parameters;

wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

2. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for calculating an air-fuel ratio correction amount in accordance with the output of said upstream-side air-fuel ratio sensor;

means for calculating an integration amount of said air-fuel ratio correction amount;

means for calculating a learning correction amount so that the integration amount of said air-fuel ratio correction amount is brought close to a reference value; and means for adjusting an actual air-fuel ratio in accordance with said air-fuel ratio correction amount, said learning correction amount, and the output of said downstream-side air-fuel sensor;

said apparatus further comprising means for calculating an air-fuel ratio feedback control parameter in accordance with the output of said downsteam-side air-fuel ratio sensor;

said air-fuel ratio correction amount calculating means calculating said air-fuel ratio correction amount in accordance with the output of said upstream-side air-fuel ratio sensor and said air-fuel ratio feedback control parameter;

wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped by when the output of said downstream-side air-fuel ratio sensor is switched from the rich side to the lean side.

* * * * *